US005278350A

United States Patent [19]

Okamoto et al.

[11] Patent Number: 5,278,350

[45] Date of Patent: Jan. 11, 1994

[54] ELECTRONIC MUSICAL INSTRUMENT FOR GENERATING MUSICAL TONE APPROXIMATE TO ACOUSTIC INSTRUMENT FOR GENERATING A SUSTAINING TONE, AND MUSICAL TONE CONTROL APPARATUS USED IN THIS ELECTRONIC MUSICAL INSTRUMENT

[75] Inventors: Tetsuo Okamoto; Satoshi Usa; Itsurou Kubota, all of Hamamatsu, Japan

[73] Assignee: Yamaha Corporation, Hamamatsu, Japan

[21] Appl. No.: 15,312

[22] Filed: Feb. 9, 1993

Related U.S. Application Data

[63] Continuation of Ser. No. 641,438, Jan. 15, 1991, abandoned.

[30] Foreign Application Priority Data

Jan. 19, 1990 [JP] Japan ..... 2-10318
Jan. 19, 1990 [JP] Japan ..... 2-10319

[51] Int. Cl.[5] ..... G10H 1/12; G10H 1/18

[52] U.S. Cl. ..... 84/658; 84/661; 84/DIG. 9; 84/DIG. 10

[58] Field of Search ..... 84/615, 626, 630, 644, 84/653, 658, 661, 662, 670, 687-690; 737

[56] References Cited

U.S. PATENT DOCUMENTS 4,430,917 2/1984 Pepper, Jr. ..... 84/690
4,932,304 6/1990 Franzmann ..... 84/644
4,984,276 1/1991 Smith .
5,010,801 4/1991 Sakashita ..... 84/737

*Primary Examiner*—Stanley J. Witkowski
*Attorney, Agent, or Firm*—Graham & James

[57] ABSTRACT

An electronic musical instrument suitable for synthesizing musical tones, comprises a musical tone control apparatus for generating velocity data and a musical tone generator for generating a musical tone signal having musical tone characteristics according to the velocity data. The musical tone control apparatus comprises an operation member which can be movably operated, a detector for detecting operation data according to an operation position or displacement amount of the operation member along its moving direction, a conversion memory for converting the operation data outputted from the detector into velocity data, and a control circuit for controlling musical tone characteristics on the basis of the velocity data outputted from the conversion memory.

15 Claims, 18 Drawing Sheets

ELECTRONIC MUSICAL INSTRUMENT FOR GENERATING MUSICAL TONE APPROXIMATE TO ACOUSTIC INSTRUMENT FOR GENERATING A SUSTAINING TONE, AND MUSICAL TONE CONTROL APPARATUS USED IN THIS ELECTRONIC MUSICAL INSTRUMENT

This is a continuation of copending application Ser. No. 07/641,438 filed on Jan. 15, 1991 and now abandoned.

BACKGROUND OF THE INVENTION

1. Field of the Invention

The present invention relates to an electronic musical instrument suitable for imitating sustaining musical tone generation of, e.g., a bowed instrument, a wind instrument, and the like, and a musical tone control apparatus used in the electronic musical instrument to improve performance expressions of the musical tone.

2. Description of the Prior Art

As an electronic musical instrument which can control musical tone characteristics, such as tone colors, tone volumes, and the like in accordance with an operation velocity, an operation pressure, and the like, an instrument which detects a key depression velocity at a keyboard to control a rising waveform of a musical tone, or detects a key depression pressure during key depression to control a sustaining waveform of a musical tone is known.

In general, in bowed instruments such as a violin, a cello, a viola, and the like, rising and falling timings of a musical tone can be designated by a bowing operation independently of a pitch designation operation by fingers. Furthermore, the bowing operation can be attained in two directions, i.e., bow pull and push strokes, and various expressions can be added to, e.g., rising, sustaining, and falling waveforms of musical tones on the basis of a bow velocity, a bow pressure, and the like in each direction.

In contrast to this, in the conventional electronic musical instrument, a pitch, rising timing, and falling timing of a musical tone are determined by an operation of a key, and rising and falling timings cannot be determined by an operation independently of the pitch designation operation unlike in the bowed instruments. Even when a rising waveform is controlled in accordance with a key depression velocity or when a sustaining waveform is controlled in accordance with a pressure during key depression, since an arbitrary velocity or pressure cannot be designated independently of the key depression operation, a waveform controllable range is limited to a narrow range, and various expressions cannot be added to musical tones unlike in the bowed instruments.

Therefore, the conventional electronic musical instrument is unsatisfactory for imitating musical tone generation of the bowed instruments.

Furthermore, in the conventional electronic musical instrument described above, a key depression velocity is detected by, e.g., measuring a contact shift timing of a switch interlocked with a key. Therefore, only one velocity data can be obtained per key depression operation, and hence, musical tone control according to a change in velocity during operation cannot be performed unlike in a bowing operation. Since a movable range of a key is narrow, a velocity range which can be designated upon key depression is also narrow, and an arbitrary velocity cannot be designated within a wide range unlike in the bowing operation.

In addition, in the conventional electronic musical instrument, although a key depression velocity and a key depression pressure during key depression are reflected in a musical tone, a key operation velocity during key depression cannot be reflected in the musical tone. Therefore, no performance expression by a combination of a pressure and a velocity is available. For example, a velocity cannot be changed while a pressure remains the same, and vise versa.

SUMMARY OF THE INVENTION

It is a first object of the present invention to provide a novel electronic musical instrument which can perform musical tone generation approximate to that of a bowed instrument, a wind instrument, or the like, and can control musical tones by a new operation method quite different from conventional methods.

It is a second object of the present invention to allow generation of sustaining musical tones with a full range of expressions.

In order to achieve the first object, an electronic musical instrument according to a first aspect of the present invention, comprises (a) operation means which can be slidably operated, (b) detection means for detecting operation data corresponding to an operation position or a displacement amount in accordance with an operation of the operation means, (c) data generation means for generating velocity data on the basis of the operation data from the detection means, and (d) musical tone generation means for generating a musical tone signal having musical tone characteristics according to the velocity data from the data generation means under a condition that the operation means is in operation.

According to the above arrangement, the operation means which can be slidably operated is arranged, and a musical tone signal is generated under a condition that the operation means is in operation. Therefore, generation or decay of a musical tone can be started in accordance with an operation or non-operation state of the operation means.

Since a velocity is designated on the basis of an operation position or a displacement amount, an arbitrary velocity can be designated within a wide range, and various expressions can be added to, e.g., rising, sustaining, or falling waveforms of musical tones.

When the electronic musical instrument of the present invention is provided with pitch designation means such as a keyboard, an arbitrary pitch can be designated to generate a musical tone, and rising and falling timings of a musical tone can be determined upon operation of the operation means independently of the pitch designation. Therefore, this instrument can be approximate to, e.g., a bowed instrument.

In the electronic musical instrument of the first aspect, the data generation means may generate velocity data corresponding to an operation position. In this case, a velocity can be changed by only changing an operation position, resulting in an easy operation. The data generation means may generate velocity data corresponding to an operation velocity. In this case, an operation velocity can be directly reflected in musical tone characteristics, and a performance of a bowed instrument can be further approximated. Furthermore, a first mode for generating velocity data in correspondence with an operation position, or a second mode for generating velocity data in correspondence with an operation velocity may be arbitrarily selected. In this case, a player can play an instrument in a favorite mode.

In the electronic musical instrument, the detection means may detect pressure data corresponding to an operation pressure in accordance with an operation of the operation means, and musical tone characteristics of a musical tone generated by the musical tone generation means may be controlled in accordance the pressure data from the detection means. In this case, a pressure can be reflected in musical tone characteristics in addition to a velocity, and a performance of a bowed instrument can be further approximated.

In order to achieve the second object of the present invention, a musical tone control apparatus according to a second aspect of the present invention, comprises (a) an operation member which can be movably operated, (b) detection means for detecting operation data according to an operation position or displacement amount of the operation member along its moving direction, (c) conversion means for converting operation data from the detection means into velocity data, and (d) control means for controlling musical tone characteristics on the basis of the velocity data from the conversion means.

The apparatus with the above-mentioned arrangement may adopt one of the following arrangements (1) to (3).

(1) Pressure detection means for detecting pressure data according to an operation pressure of the operation member is arranged, and the control means controls musical tone characteristics on the basis of velocity data from the conversion means and pressure data from the pressure detection means.

(2) A press detection unit is arranged on a portion of the operation member, and pressure detection means for detecting pressure data according to an operation pressure at the press operation unit is arranged. The control means controls musical tone characteristics on the basis of velocity data from the conversion means and pressure data from the pressure detection means.

(3) Pressure designation means for generating pressure data according to a movement in a direction different from a pressing direction and a moving direction of the operation member is arranged, and the control means controls musical tone characteristics on the basis of velocity data from the conversion means and pressure data from the pressure designation means.

According to the above-mentioned arrangement, when the operation member is reciprocally operated, musical tone characteristics can be controlled in accordance with velocity data in both forward and reverse directions. Since operation data according to an operation position or a displacement amount of the operation member is detected and is converted into velocity data, a velocity can be arbitrarily designated within a wide range. Therefore, various performance expressions can be obtained by a reciprocal operation similar to, e.g., a bowing operation of a bowed instrument over a wide velocity range.

When musical tone characteristics are also controlled using pressure data from one of the arrangements (1) to (3), the number of kinds of performance expressions can be further increased by a combination of pressure and velocity data. When the arrangement (2) or (3) is employed, a depression operation of the operation member itself can be disregarded, and a pressure designation operation can be facilitated, thus allowing performance expressions effectively utilizing a change in pressure.

DETAILED DESCRIPTION OF THE PREFERRED EMBODIMENTS

An embodiment of the present invention will be described in detail hereinafter.

Figure 1:
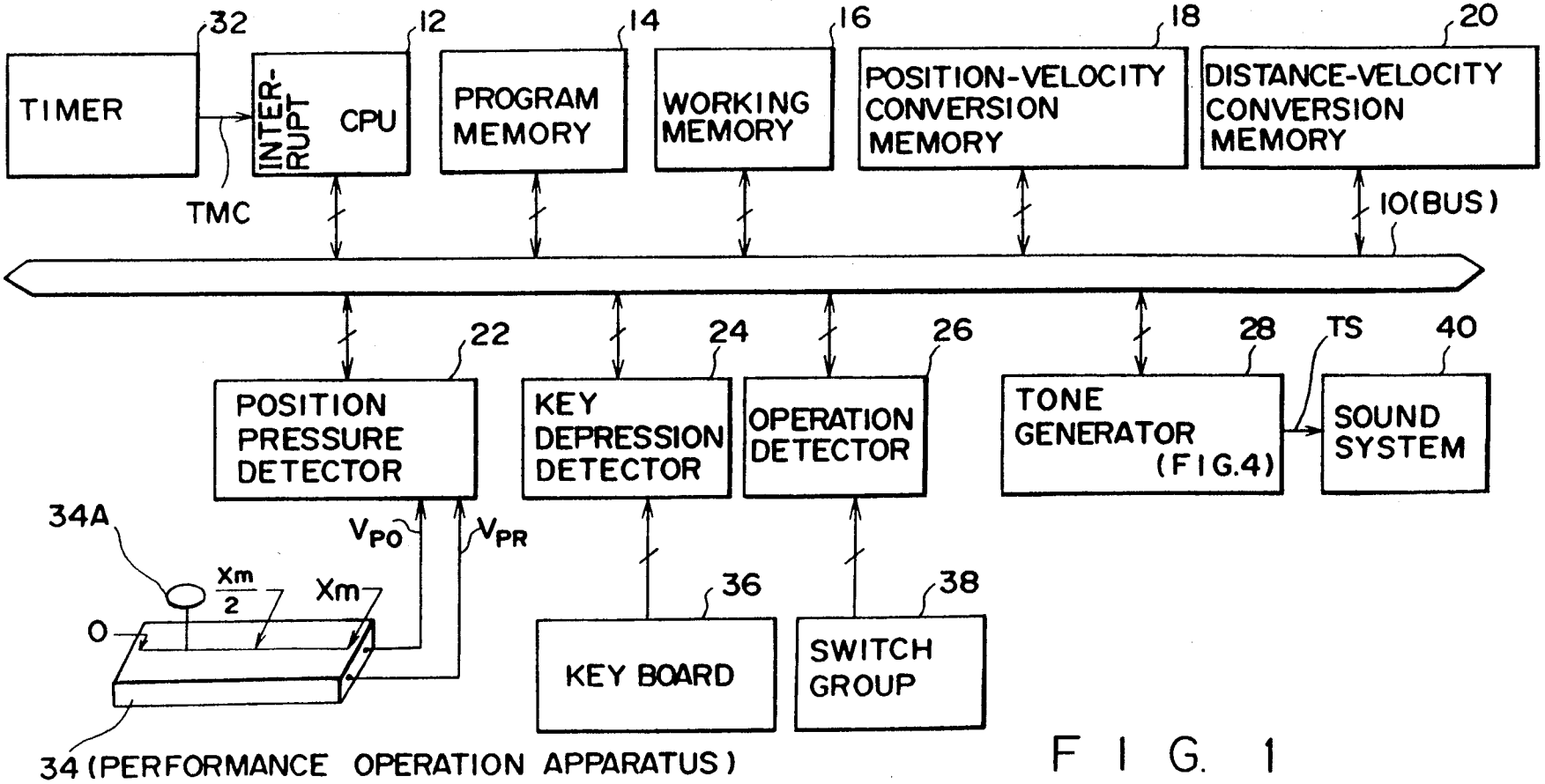
FIG. 1 is a block diagram showing an arrangement of an electronic musical instrument according to an embodiment of the present invention.
Figure 4:
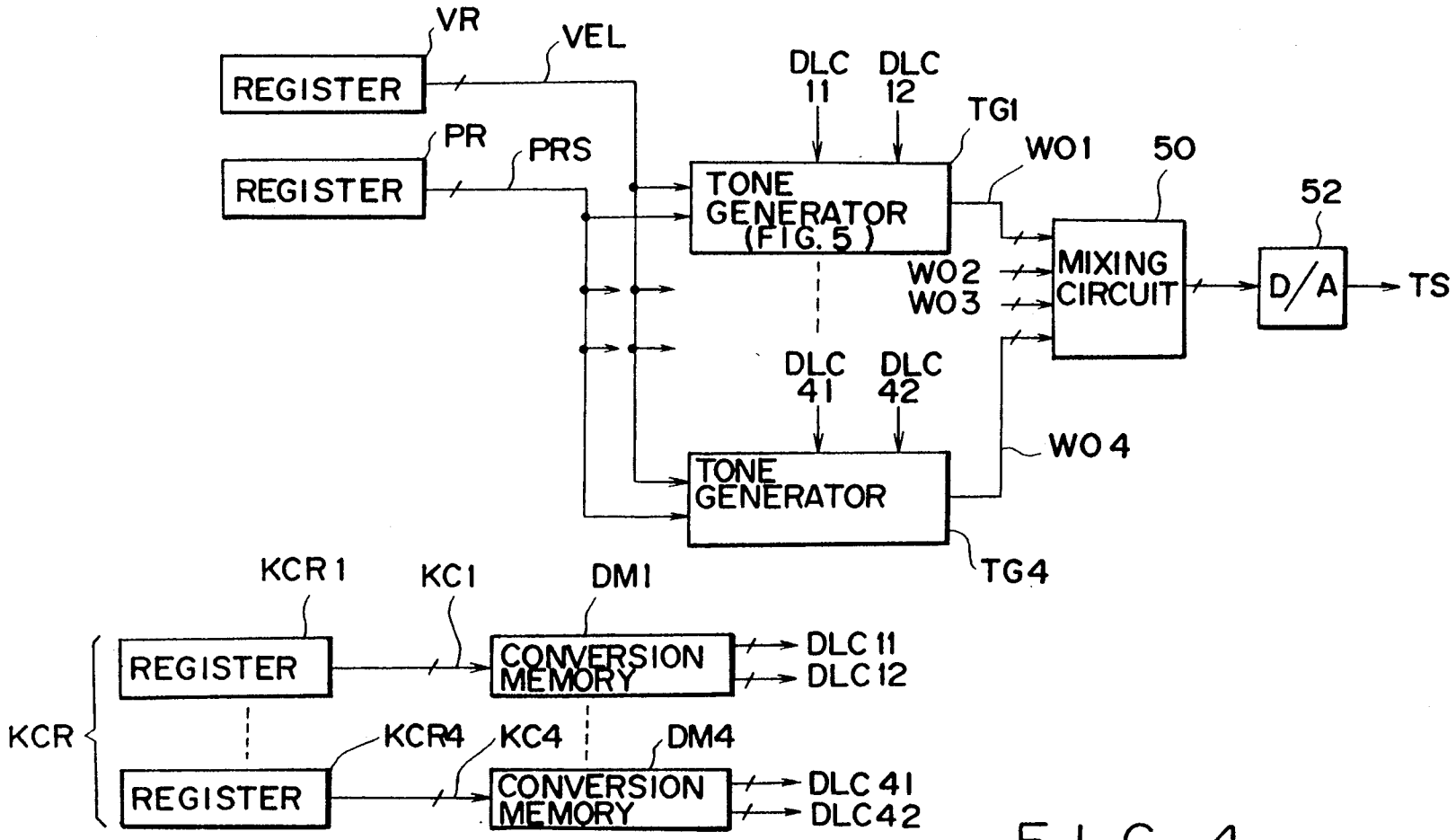
FIG. 4 is a circuit diagram showing an arrangement of a tone generator circuit 28.
Figure 5:
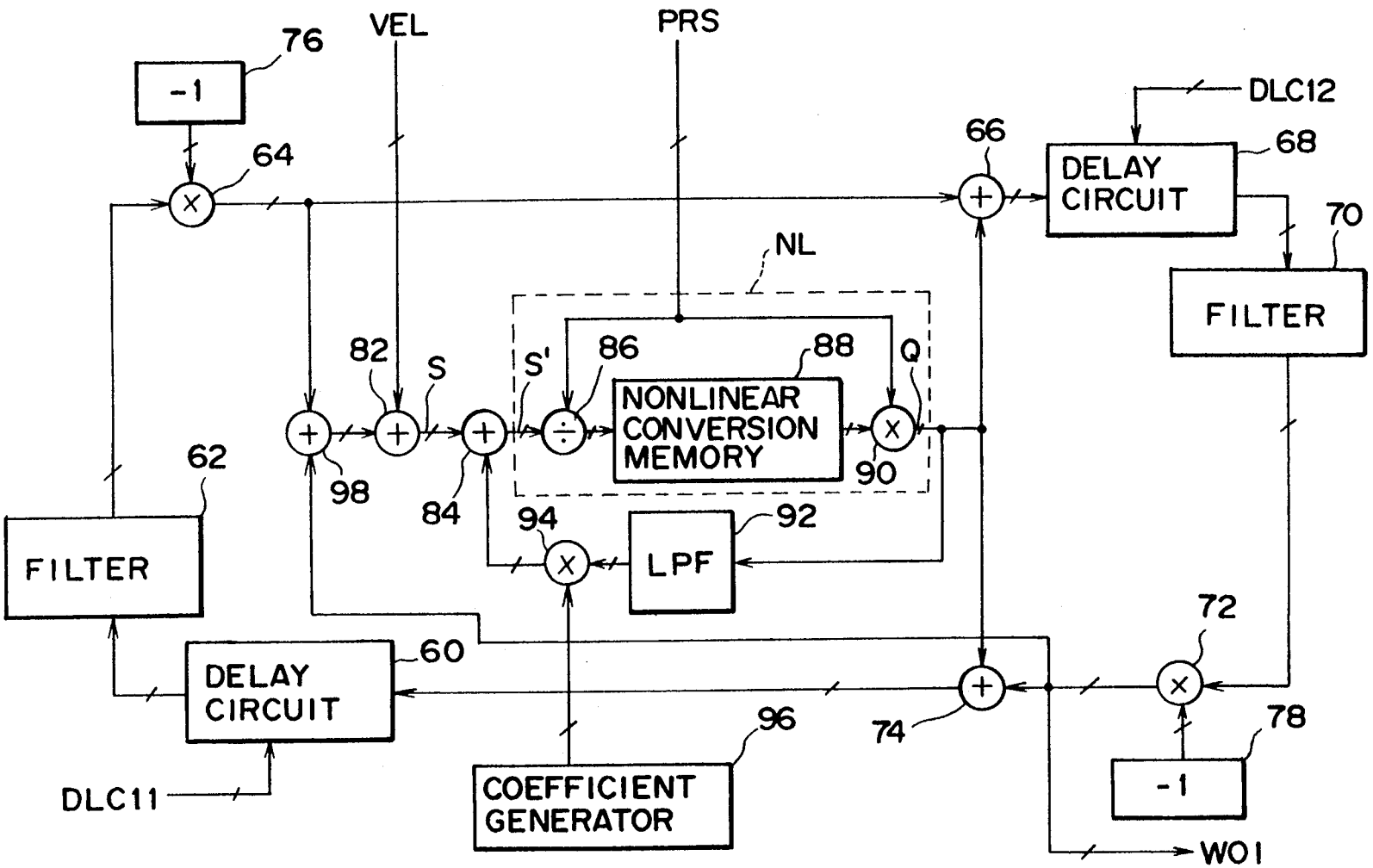
FIG. 5 is a circuit diagram showing an arrangement of a tone generator TG1.

FIGS. 1, 4, and 5 show an arrangement of an electronic musical instrument according to an embodiment of the present invention. In the electronic musical instrument, musical tone generation is controlled by a microcomputer. Note that in FIGS. 1, 4, and 5, hatched signal lines represent that they include a plurality of signal lines or data including a plurality of bits are to be transmitted therethrough.

(1) Circuit Arrangement (FIG. 1)

A bus 10 is connected to a central processing unit (CPU) 12, a program memory 14, a working memory 16, a position-velocity conversion memory 18, a distance-velocity conversion memory 20, a position-pressure detector 22, a key depression detector 24, an operation detector 26, a tone generator circuit 28, and the like.

The CPU 12 executes various processing operations for musical tone generation in accordance with a program stored in the memory 14. These processing operations will be described later with reference to FIGS. 27 to 30. The CPU 12 has a timer 32. The timer 32 supplies a timer clock signal TMC having a clock cycle of 1 to 10 ms, and preferably 3 ms, to the CPU 12 as an interrupt command signal.

The working memory 16 includes a large number of registers which are used during the various processing operations of the CPU 12. Registers associated with the embodiment of the present invention will be described later.

The position-pressure detector 22 has a performance operation apparatus 34 having an operation member (knob) 34A. The apparatus 34 can detect an operation position and an operation pressure of the knob 34A when the knob 34A is slidably operated along the longitudinal direction of the apparatus 34, and a detailed arrangement of the apparatus 34 will be described later with reference to FIG. 12. Note that operation positions along the longitudinal direction are expressed by coordinate values 0 to $X_m$ for the sake of simplicity.

The position-pressure detector 22 detects the voltage signal $V_{PO}$ corresponding to an operation position, and the voltage signal $V_{PR}$ corresponding to an operation pressure from the performance operation apparatus 34, and converts these voltage signals $V_{PO}$ and $V_{PR}$ into digital position data and pressure data, respectively.

Figure 2:
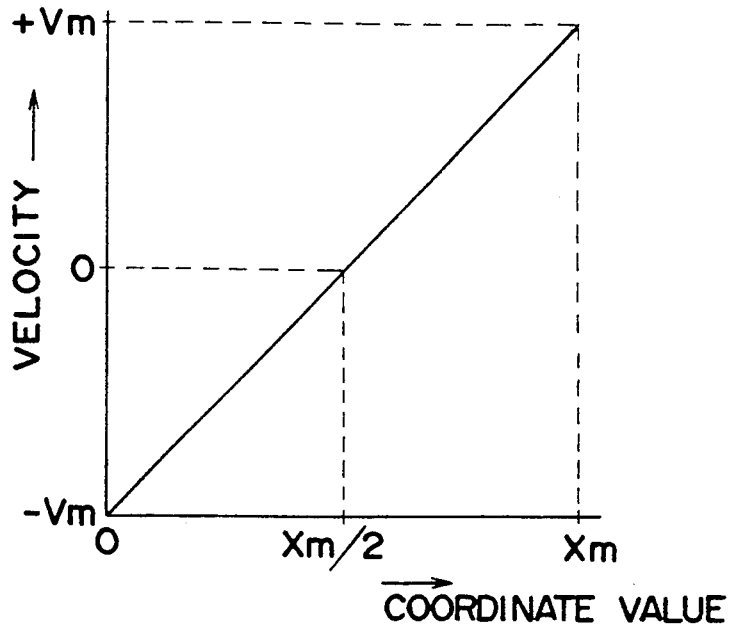
FIGS. 2 and 3 are graphs for exemplifying conversion characteristics of memories 18 and 20, respectively.

The position-velocity conversion memory 18 converts position data from the detector 22 into velocity data in accordance with conversion characteristics exemplified in FIG. 2. The distance-velocity conversion memory 20 converts a moving distance per unit time (operation velocity) obtained based on the position data from the detector 22 into velocity data in accordance with conversion characteristics exemplified in FIG. 3. In this embodiment, a position mode using velocity data corresponding to an operation position, or a velocity mode using velocity data corresponding to an operation velocity can be arbitrarily selected upon operation of a mode switch.

In the position mode, the velocity is constant if the operation position is fixed. So, the operation is easily performed in the position mode. As a result, a player can designate a pitch by one hand, and can operate the operator by the other hand.

The velocity mode meets with sense of the performer because the operation in the velocity mode is similar to that of the bowed-string instrument. As a result, this mode is suitable for performance with delicate expression.

The key depression detector 24 detects key depression data (key ON/OFF data and key code date) in units of keys of a keyboard 36.

The operation detector 26 detects operation data in units of switches in a switch group 38 including the above-mentioned mode switch, and the like.

The tone generator circuit 28 forms and outputs a musical tone signal TS on the basis of the velocity data, the pressure data, the key depression data, and the like mentioned above, and will be described in detail later with reference to FIG. 4.

The musical tone signal TS from the tone generator circuit 28 is supplied to a sound system 40 including an output amplifier, a loudspeaker, and the like, and is produced as an actual musical tone.

(2) Tone Generator circuit 28 (FIG. 4)

FIG. 4 shows an arrangement of the tone generator circuit 28, and the tone generator circuit 28 includes four tone generators TG1 to TG4 corresponding to four strings of a violin. Therefore, in this embodiment, a maximum of four tones can be simultaneously generated. The tone generators TG1 to TG4 have the same arrangement, and perform the same operation. Thus, the arrangement and operation of the tone generator TG1 will be exemplified later.

A register VR stores the velocity data read out from the memory 18. Velocity data VEL outputted from this register is supplied to the tone generators TG1 to TG4. A register PR stores the pressure data. Pressure data PRS from this register is supplied to the tone generators TG1 to TG4.

Registers KCR1 to KCR4 are arranged in correspondence with the tone generators TG1 to TG4, and store key code data (pitch data) corresponding to keys depressed at the keyboard 36. Key code data KC1 to KC4 from the registers KCR1 to KCR4 are supplied to key code-delay amount conversion memories DM2 to DM4.

Each of the conversion memories DM1 to DM4 stores first and second delay amount data in units of keys of the keyboard 36. The first and second delay amount data for a given key are used to distribute a total delay amount corresponding to a pitch of the given key to first and second delay means (e.g., 60 and 68 in FIG. 5) at a predetermined distribution ratio. If the total delay amount (e.g., the number of delay stages) is represented by D and the distribution ratio is represented by K (K is a value falling within a range of $0<K<1$, and is, e.g., 0.5), the first delay data expresses a delay amount given by $D\times K$, and the second delay amount data expresses a delay amount given by $D\times(1-K)$.

For example, the conversion memory DM1 converts input key code data KC1 into first and second delay amount data DLC11 and DLC12 corresponding to a pitch, and supplies these data to the tone generator TG1. Note that if the value of the register KCR1 is 0 (i.e., no key code data), data for disabling the first and second delay means of the tone generator TG1 are supplied as the data DLC11 and DLC12.

As for the remaining tone generators TG2 to TG4, delay amount data DLC21, DLC22, . . . , DLC41, and DLC42 are supplied in the same manner as in the tone generator TG1.

The tone generators TG1 to TG4 generate digital musical tone waveform data on the basis of the tone generator control data supplied as described above. Musical tone waveform data WO1 to WO4 from the tone generators TG1 to TG4 are mixed by a mixing circuit 50. Musical tone waveform data from the mixing circuit 50 is converted into an analog musical tone signal TS by a digital-to-analog (D/A) converter 52. The musical tone signal TS is supplied to the sound system 40 (FIG. 1).

(3) Tone Generator TG1 (FIG. 5)

FIG. 5 shows an arrangement of the tone generator TG1. The tone generator TG1 can imitate a bowed string tone.

A variable delay circuit 60, a filter 62, a multiplier 64, an adder 66, a variable delay circuit 68, a filter 70, a multiplier 72, and an adder 74 are connected to form a closed loop, thus constituting a data circulating path. A total delay time of the data circulating path corresponds to the length of a string (vibrator), i.e., a fundamental wave cycle of a tone to be generated. A propagation/-distribution state of a vibration on the string is expressed by waveform data which circulates through the data circulating path.

The delay circuits 60 and 68 are set and controlled, so that their delay amounts are equal to values indicated by the delay amount data DLC11 and DLC12, respectively. A pitch corresponding to the total delay amount of the delay circuits 60 and 68 is provided to waveform data which circulates through the data circulating path. Strictly speaking, since a pitch of a musical tone to be generated is determined by a total sum of delay amounts in the closed loop, the total delay amount of the circuits 60 and 68 is determined in consideration of delay amounts of the filters and the like in the closed loop in advance, thus obtaining a pitch corresponding to the total delay amount.

The filters 62 and 70 are used to imitate a loss corresponding to a vibration propagation due to a material of a string, and to imitate nonlinearity of a propagation velocity with respect to a frequency. For the former imitation, a low-pass filter is employed. For the later imitation, an all-pass filter is employed, and generation of fractional-order overtones can be realized by utilizing the fact that frequency vs. delay characteristics of the all-pass filter have nonlinearity.

The multipliers 64 and 72 multiply negative coefficients from coefficient generators 76 and 78 with circulating waveform data to imitate phase inversion corresponding to reflection of a vibration wave at one and the other ends of a string. In this case, the negative coefficients are set to be $-1$ if it is assumed that there is no loss at the fixed ends of a string, or are selected from a range of 0 to $-1$ if it is assumed that there is no loss at the fixed ends of a string, or are selected from a range of 0 to $-1$ in correspondence with losses if it is assumed that there are steady losses at the fixed ends of a string. These coefficients may be changed over time as needed.

The adders 66 and 74 are used to introduce excitation waveform data from a nonlinear conversion unit NL to the data circulating path.

The velocity data VEL is supplied to the nonlinear conversion unit NL via adders 82 and 84. The conversion unit NL is arranged to imitate a nonlinear change of a bowed string, and comprises a divider 86 for receiving an output from the adder 84, a nonlinear conversion memory 88 for receiving an output from the divider 86, and a multiplier 90 for receiving an output from the memory 88. The divider 86 and the multiplier 90 receive the pressure data PRS, and the multiplier 90 outputs the excitation wave form data.

Figure 6:
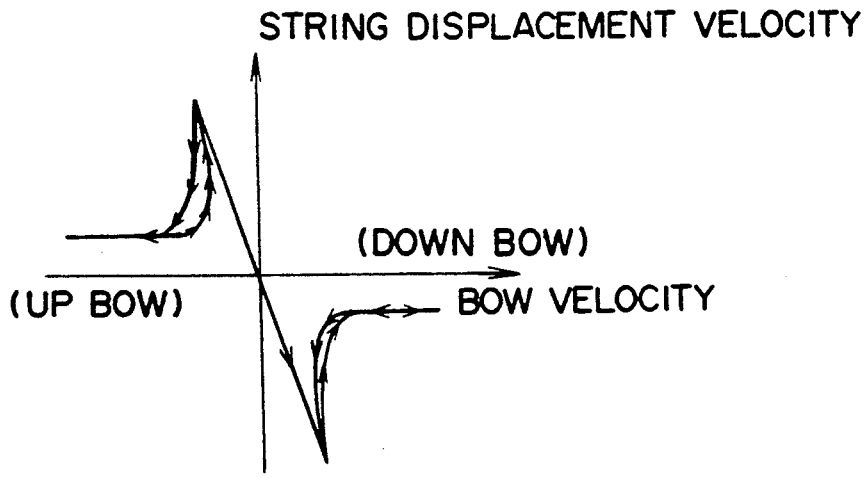
FIG. 6 is a graph for exemplifying a nonlinear change of a bowed string.

FIG. 6 shows a nonlinear change of a bowed string. A velocity of a bow relative to a string is plotted along the abscissa, and a displacement velocity given from the bow to the string is plotted along the ordinate. As is well known, when a bow velocity is near 0, a string displacement velocity is linearly increased as the bow velocity is increased since a contribution of a static friction is dominant. When a predetermined external force or higher is applied, a dynamic friction becomes dominant, and the contribution of the external force to the bow displacement velocity is decreased immediately, thus obtaining a nonlinear change, as shown in FIG. 6. It is also known that a hysteresis phenomenon shown in FIG. 6 occurs during a transition between the static friction and the dynamic friction.

Figure 7:
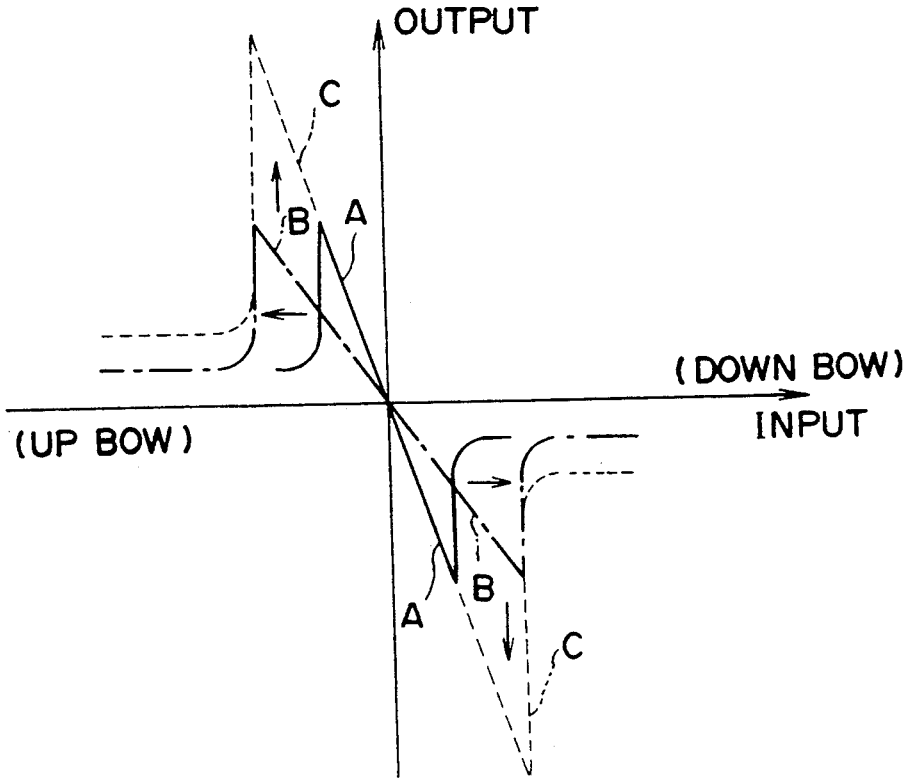
FIG. 7 is a graph for exemplifying a change in characteristics in a nonlinear conversion unit NL.

In order to imitate a nonlinear change shown in FIG. 6, the nonlinear conversion memory 88 stores numerical value data according to conversion characteristics expressed by a solid curve A in FIG. 7. In order to imitate a change in static friction region according to a bow pressure, the divider 86 and the multiplier 90 are arranged at the input and output sides of the memory 88, respectively, to perform division and multiplication with the pressure data PRS. When input data to the memory 88 is divided with the pressure data PRS, the characteristics represented by the curve A in FIG. 7 are converted to characteristics represented by an alternate long and short dashed curve B in FIG. 7. When output data from the memory 88 is multiplied with the pressure data PRS, the characteristics expressed by the curve B in FIG. 7 are converted to characteristics represented by a broken curve C in FIG. 7. In order to change characteristics according to the pressure data PRS, the present invention is not limited to the above-mentioned calculation method. For example, conversion characteristics may be stored in units of pressure values, and conversion characteristics to be used may be designated according to the pressure data PRS.

Figure 8:
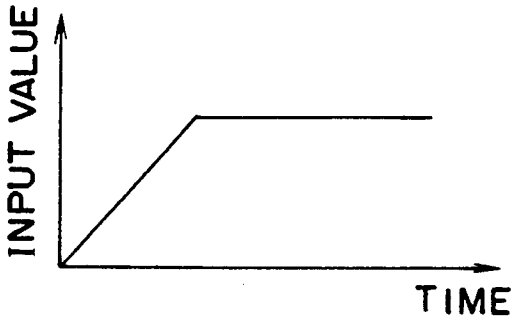
FIGS. 8 and 9 are waveform charts showing inputs and outputs of the nonlinear conversion unit NL.
Figure 9:
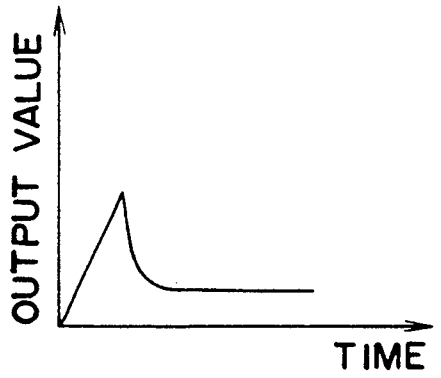

For Example, when velocity data representing a change over time shown in FIG. 8 is inputted to the nonlinear conversion unit NL, excitation waveform data shown in FIG. 9 can be outputted from the nonlinear conversion unit NL, and is inputted to the data circulating path via the adders 66 and 74.

In order to imitate the above-mentioned hysteresis phenomenon, the nonlinear conversion unit NL comprises a feedback path including a low-pass filter (LPF) 92 for receiving an output Q from the multiplier 90, a multiplier 94 for multiplying a coefficient from a coefficient generator 96 with an output from the LPF 92, and the adder 84 for adding the output from the multiplier 94 to an output S from the adder 82, and supplying a sum output S' to the divider 86. The LPF 92 is arranged to prevent oscillation and to attain gain or phase compensation. Since an output waveform of the nonlinear conversion unit NL is changed in accordance with filter characteristics, a change in tone color can be obtained.

Figure 10:
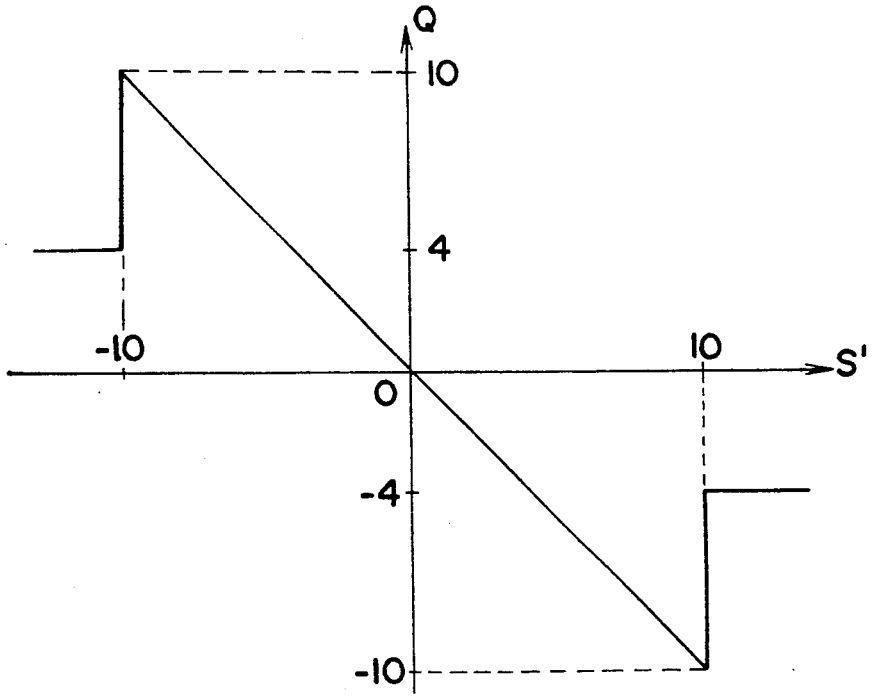
FIG. 10 is a graph showing nonlinear conversion characteristics.
Figure 11:
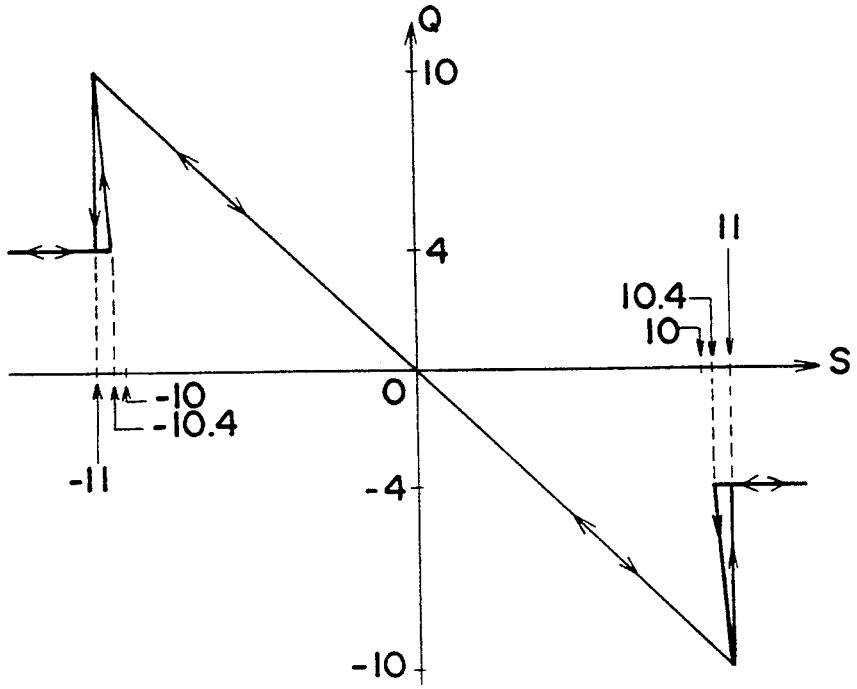
FIG. 11 is a graph showing an example for adding a hysteresis by a feedback operation.

For example, if the nonlinear conversion unit NL is assumed to have conversion characteristics (input S' vs. output Q characteristics) shown in FIG. 10, and if a feedback ratio $\beta=0.1$ (i.e., 10%), conversion characteristics (input S vs. output Q characteristics) of a circuit portion including the feedback path and the nonlinear conversion unit NL have hysteresis characteristics shown in FIG. 11. In this case, for example, when a coefficient generated by the coefficient generator 96 is changed to change a feedback ratio, the hysteresis characteristics can be changed. If a change in feedback ratio is controlled in accordance with velocity data VEL or pressure data PRS, a musical tone further approximate to a bowed string tone can be generated. Note that in order to obtain hysteresis characteristics, the present invention is not limited to the above-mentioned feedback method. For example, conversion characteristics in units of change directions of input values may be stored in the memory 88, and conversion characteristics to be used may be designated upon detection of a change direction of an input value.

An adder 98 adds the outputs from the multipliers 64 and 72, and supplies the sum to the adder 82. Since the adder 98 is arranged, circulating path via the nonlinear conversion unit NL, and a complicated change in waveform can be obtained.

The musical tone waveform data WO1 consisting of circulating waveform data is outputted from the output side of the multiplier 72. The output position is not limited to one shown in FIG. 8, but may be any other positions as long as waveform data can be circulated. The waveform data need not always be outputted from only one position but may be outputted from a plurality of positions and then mixed to obtain final data.

Since the above-mentioned tone generator TG1 has a delay loop structure including the filters, it exhibits so-called comb filter characteristics. When excitation waveform data expressing the relationship between a string and a bow is inputted from the nonlinear conversion unit NL to the data circulating path, waveform data representing an overtone spectrum pattern according to a resonance peak frequency of the comb filter circulates through the data circulating path.

The tone generator TG1 generates the musical tone waveform data WO1 under a condition that it receives the velocity data VEL and the pressure data PRS, and also receives the data DLC11 and DLC12 which represent delay amounts. Therefore, when none of keys at the keyboard 36 are depressed, or when no key code data is set in the register KCR1 even if a key is depressed, no musical tone waveform data is generated even if the knob 34A of the performance operation apparatus 34 is slid. Even when key code data is set in the register KCR1, no musical tone waveform data is generated unless the knob 34A is slid.

When a slide operation of the knob 34A is started in a state wherein key code data is set in the register KCR1, a variety of expressions can be given to the rising waveform of a musical tone depending on the way of applying an operation force at that time (e.g., quickly or gradually). When an operation velocity and/or and operation pressure are/is adjusted during generation of a musical tone, a variety of expressions can also be given to a musical tone. In addition, a variety of expressions can be given to the falling waveform of a musical tone depending on the way of disabling an operation force (e.g., quickly or gradually) when a decay of the musical tone is started later.

Expressions can be also added to a musical tone when key code data is set in the register KCR1 according to a key depression operation after the slide operation of the knob 34A is started.

When the register KCR1 is cleared according to a key OFF event during generation of a musical tone, since the delay circuits 60 and 68 are disabled, the musical tone is quickly decayed. When the slide operation of the knob 34A is stopped without clearing the register KCR1 during generation of a musical tone, since circulating waveform data suffers from a loss of the circulating path, the musical tone is gradually decayed. Therefore, two different decay modes, i.e., quick and slow decay modes can be obtained.

Decay control upon a key OFF event need not always be attained by disabling the delay circuits 60 and 68. For example, a variable attenuator may be inserted in the data circulating path, and its degree of attenuation may be increased upon detection of a key OFF event, or the gain of the filter 62 and/or the gain of the filter 70 may be controlled to be decreased upon detection of a key OFF event. Thus, various other methods may be employed.

(4) Working Memory 16

Of the registers in the working memory 16, ones associated with the embodiment of the present invention are as follows.

(1) Mode register MD . . . This register is set with "1" or "0" upon operation of the mode switch. If "1" is set, it represents the velocity mode, and if "0" is set, it represents the position mode.

(2) Key code register KCD . . . This register stores key code data corresponding to a key associated with event detection every time a key ON or key OFF event is detected through the detector 24.

(3) Tone generator ON/OFF register KOR . . . This register includes four registers KOR1 to KOR4 corresponding to the registers KCR1 to KCR4 shown in FIG. 7, and if a content of a register is "1", it represents that a corresponding tone generator is generating a tone; if it is "0", it represents that the corresponding tone generator is not generating a tone.

(4) Position register POS . . . This register is set with position data from the detector 22.

(5) Pressure register PRES . . . This register is set with pressure data from the detector 22.

(6) Old position register OPOS . . . This register is set with the position data from the register POS. The content of the register POS represents an operation position at the present timer interruption, while the content of the register OPOS represents an operation position at the previous timer interruption.

(7) Data flag OLD . . . This flag represents the presence/absence of data in the register OPOS. If this flag is "1", it represents the presence of data; if it is "0", it represents the absence of data.

(8) Distance register DIST . . . This register is set with a difference (moving distance per unit time) obtained by subtracting the value of the register POS from that of the register OPOS.

(5) Performance Operation Apparatus (FIGS. 12 to 26)

Figure 12:
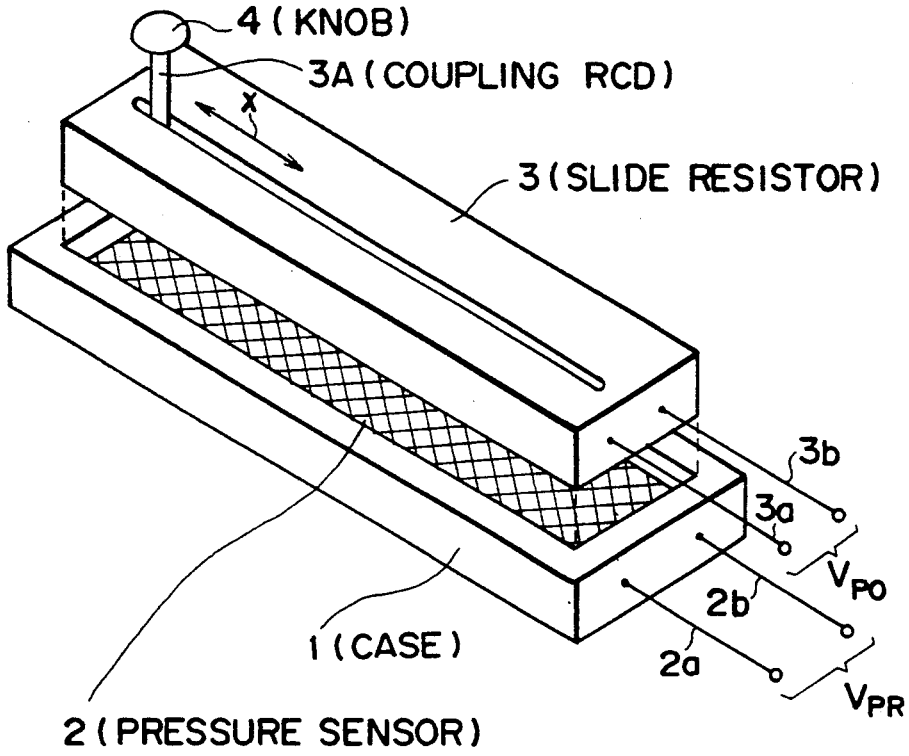
FIG. 12 is an exploded perspective view showing a performance operation apparatus.

FIG. 12 shows an arrangement of the performance operation apparatus used in the embodiment of the present invention.

In the apparatus shown in FIG. 12, a flat pressure sensor 2 is arranged on the bottom surface of a box-like case 1 having an upper opening, and a slide resistor 3 is vertically movably housed in the case 1 to be overlaid on the pressure sensor 2. In the slide resistor 3, a knob 4 is coupled to a slider (not shown) through a coupling rod 3A. Thus, a player can hold the knob 4 to reciprocally slide the slider along the longitudinal direction (direction of an arrow x) of the resistor 3.

When a slide operation is performed by the knob 4 while a current is supplied to the resistor 3, a voltage signal $V_{PO}$ corresponding to an operation position can be extracted from a pair of terminals 3*a* and 3*b* of the resistor 3, and a voltage signal $V_{PR}$ corresponding to an operation pressure can be extracted from a pair of terminals 2*a* and 2*b* of the pressure sensor 2.

Figure 13:
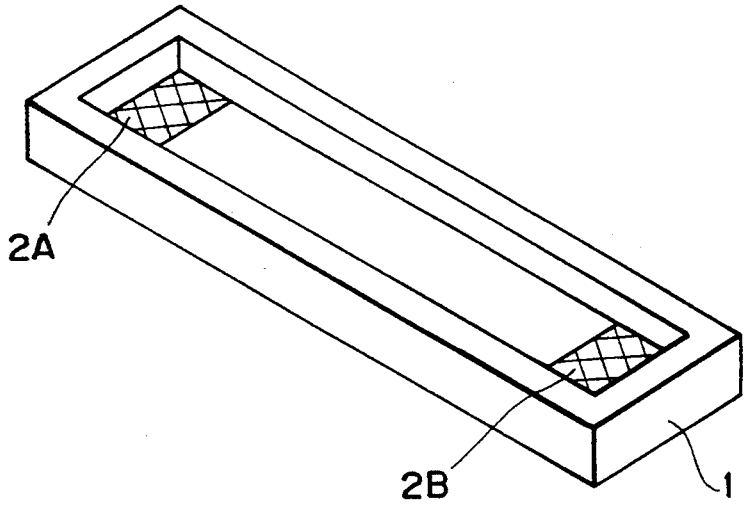
FIG. 13 is a perspective view showing a modification of a pressure detection unit.

The pressure sensor 2 may be arranged to be divided into a plurality of sensors 2A and 2B, as shown in FIG. 13, and output signals from the plurality of pressure sensors 2A and 2B may be averaged.

Figure 14:
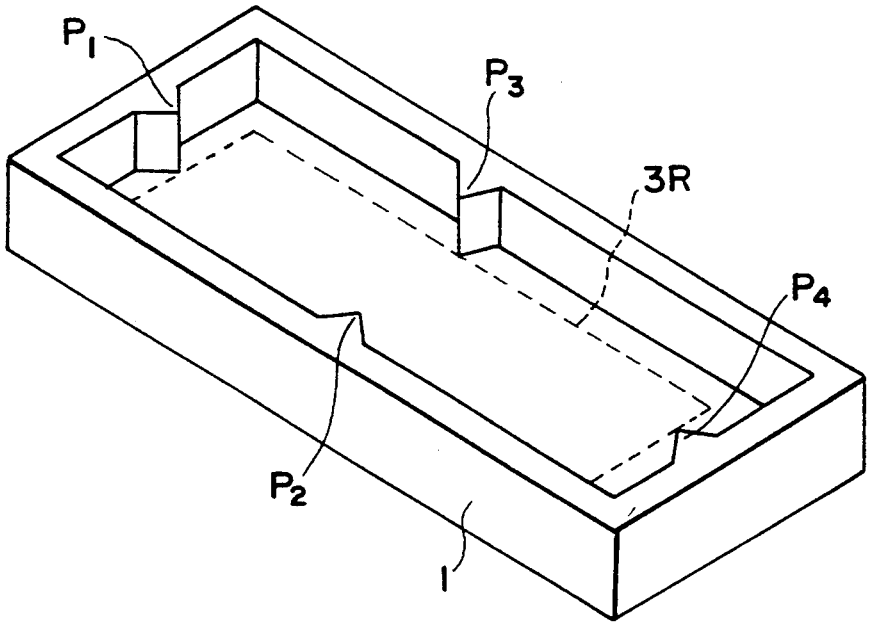
FIG. 14 is a perspective view showing a modification of a case.

A plurality of inward projections $P_1$ to $P_4$ in FIG. 14 may be formed in the case 1 to decrease a contact area between the case 1 and the resistor 3, thereby allowing smooth pressure detection. Note that in FIG. 14, reference numeral 3R denotes a region where the resistor 3 is to be overlaid.

Figure 15:
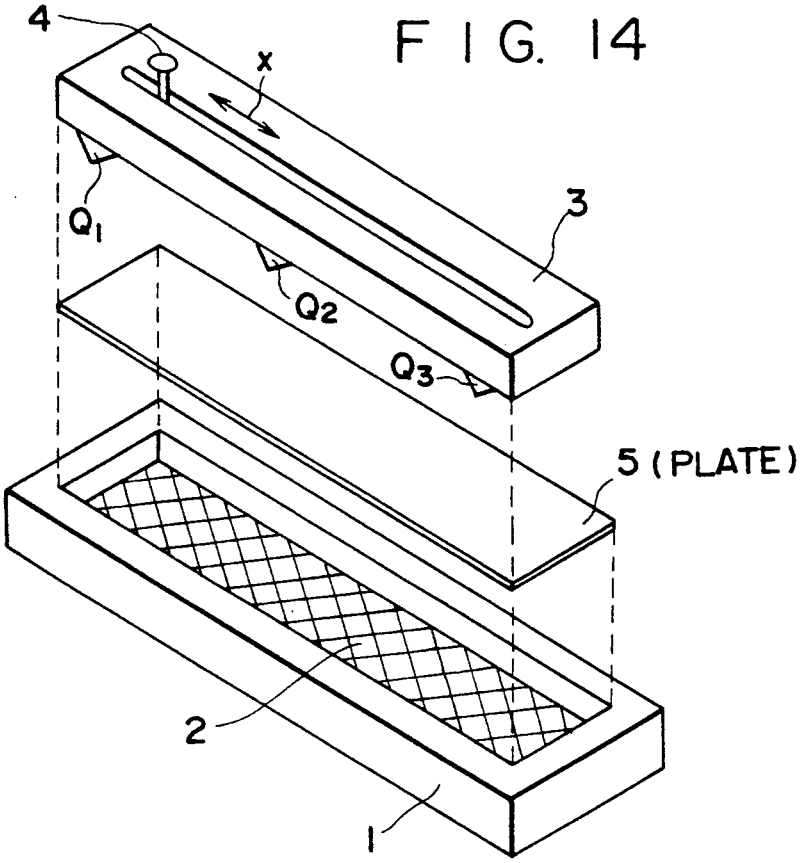
FIG. 15 is an exploded perspective view showing another modification of the pressure detection unit.

FIG. 15 shows a modification of a pressure detection unit. This pressure detection unit is arranged to allow a uniform compression of the pressure sensor. More specifically, downward projections $Q_1$ to $Q_3$ are formed on the lower surface of the slide resister 3, and the resistor 3 is overlaid on the pressure sensor 2 via a smoothing plate 5. In this case, even when the position of the knob 4 is changed, the pressure sensor 2 can be uniformly urged through the smoothing plate 5, and pressure non-uniformity can be eliminated.

Figure 16:
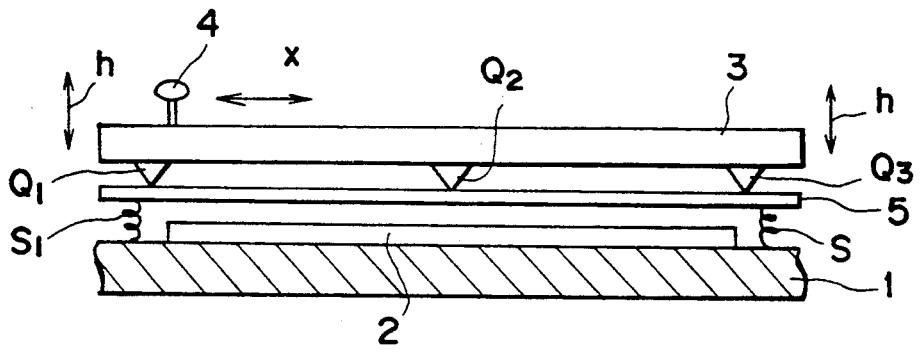
FIG. 16 is a side view showing still another modification of the pressure detection unit.

In the structure shown in FIG. 15, elastic members such as springs $S_1$, $S_2$, and the like may be interposed between the smoothing plate 5 and the bottom surface of the case 1, as shown in FIG. 16. In this case, no force can be applied to the pressure sensor 2 unless a force is applied downward by a hand, and an offset caused by the weight of the slide resistor 3 can be eliminated. In addition, since a displacement of the knob 4 in a pressing direction (direction of an arrow h) can have a sufficient margin, a natural performance feeling can be obtained, and a push feeling as if a string were pushed by a bow can also be obtained.

Figure 17:
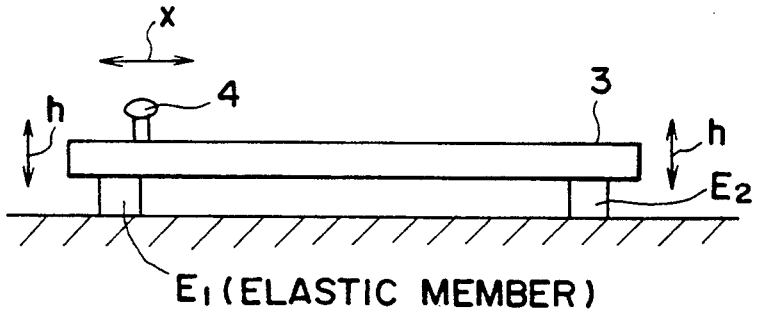
FIG. 17 is a side view showing a modification of an arrangement of a resistor.

FIG. 17 shows a modification of the arrangement of the resistor. In this modification, elastic members $E_1$ and $E_2$ such as springs, sponges, and the like are arranged on the lower surface of the slide resistor 3, that is, a displacement of the knob 4 in a pressing direction can have a sufficient margin, thereby obtaining a natural performance feeling and push feeling, as described above. In this case, pressure detection and pressure designation can be performed by a method to be described later with reference to FIGS. 19 to 21.

Figure 18:
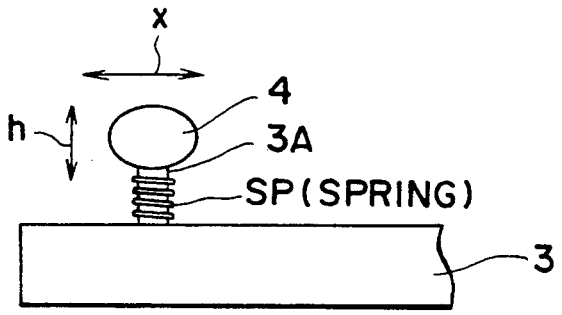
FIG. 18 is a side view showing a modification of a coupling portion.

FIG. 18 shows a modification of a coupling portion of the slide resister 3. In this modification, a spring SP is wound around the coupling rod 3A having the knob 4, and the coupling rod 3A is mounted on the slider to be vertically movable within a predetermined range. In this structure, the natural performance feeling and push feeling as described above with reference to FIG. 17 can be obtained. In this case, pressure detection or pressure designation may be performed by the method shown in FIG. 12 or 13 or may be performed by a method shown in FIGS. 19 to 21.

Figure 19:
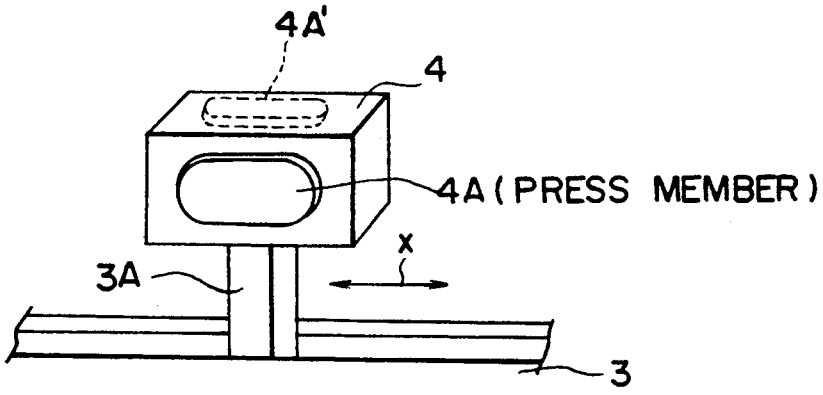
FIG. 19 is a perspective view showing another pressure detection means.
Figure 20:
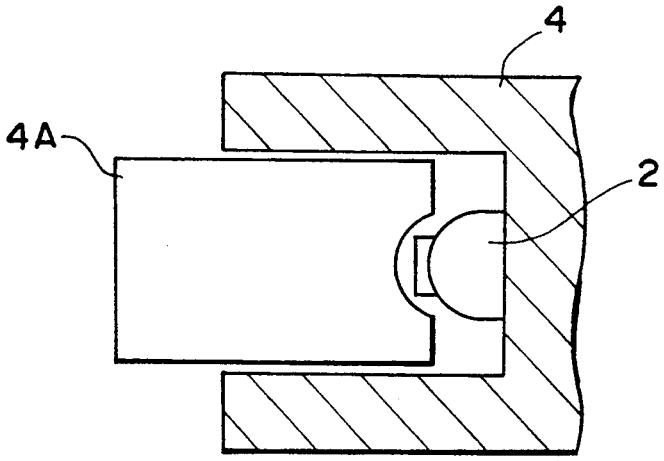
FIG. 20 is a sectional view of a knob shown in FIG. 19.

FIG. 19 shows another pressure detection means. In this case, a press member 4A is movably arranged in a side hole of the knob 4 so as not to be disengaged outwardly, and the pressure sensor 2 is arranged in the hole so as to be pressed via the press member 4A, as shown in FIG. 20. Note that the pressure detection unit may be arranged on the upper portion of the knob 4, as indicated by a broken line 4A'.

In this structure, when a slide operation is performed while holding the knob 4, the press member 4A (or 4A') is pressed by a portion of a hand or a finger, pressure data corresponding to a desired pressure can be extracted from the pressure sensor 2. In this case, the pressure detection means shown in FIG. 12 or 13 can be omitted.

Figure 21:
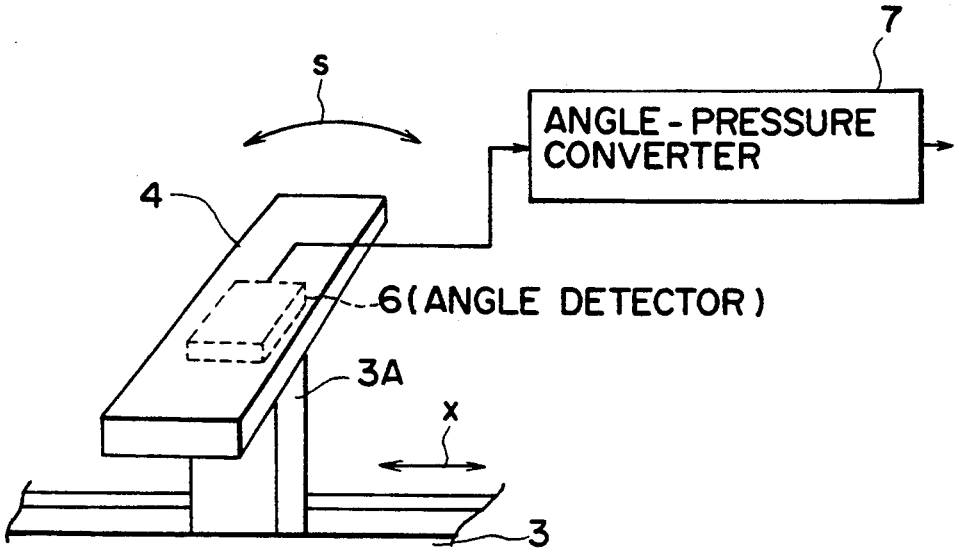
FIG. 21 is a perspective view showing a pressure designation means.

FIG. 21 shows a pressure designation means. In this case, the knob 4 is arranged on the coupling rod 3A of the slide resistor 3 so that its angle can be changed as indicated by an arrow S, and an angle detector 6 for detecting a displacement angle of the knob 4 from its reference position, and an angle-pressure converter 7 for converting the displacement angle data from the angle detector into pressure data are arranged. When the knob 4 is twisted, an arbitrary pressure can be designated.

Since the pressure designation means shown in FIGS. 19 to 21 can designate a desired pressure independently of an operation for pressing the knob 4, they are suitable for slightly changing a pressure during the slide operation.

Figure 22:
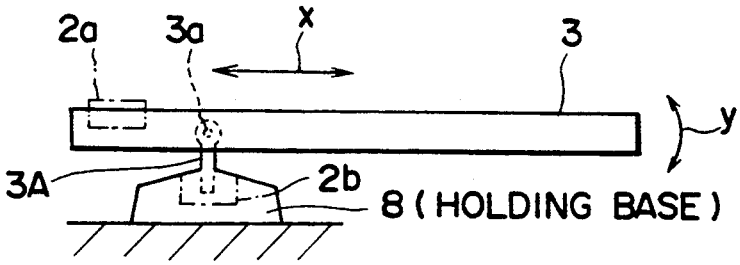
FIGS. 22 and 23 are side views showing other performance operation apparatuses.

FIG. 22 shows another structure of the performance operation apparatus. In this apparatus, the coupling rod 3A of the slide resistor 3 is held on a holding base 8, and a slide operation is performed in a direction of an arrow x while holding a main body of the resistor 3 with a hand. In this case, it is preferable that the coupling rod 3A is axially fixed on the slider, as designated by **3*a*, so that the main body of the resistor 3 is pivotal in a y direction. A pressure detection unit 2*a* similar to that shown in FIG. 19 is arranged on a holding portion of the main body of the resistor, or an appropriate pressure sensor 2*b* is arranged on the holding base 8**, thus allowing pressure designation or pressure detection.

According to this structure, a performance operation further approximate to a bowing operation can be performed.

Figure 23:
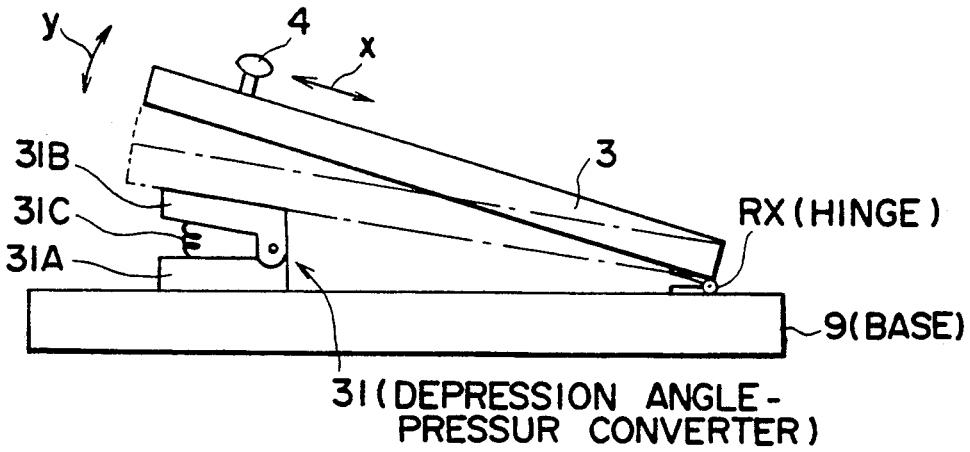

FIG. 23 shows still another structure of the performance operation apparatus. In this apparatus, one end portion of the slide resistor 3 is mounted on a base 9 via a hinge RX so as to be pivotal in a y direction, and a press angle-pressure converter 31 is arranged on the base 9 at a position corresponding to the other end portion of the resistor 3. In the converter 31, a movable member 31B is mounted on a support member 31A to be pivotal within a predetermined range, and a spring 31C is arranged between the support member 31A and the movable member 31B. In the converter 31, a press angle of the movable member 31B is detected by an angle detector (corresponding to 6 in FIG. 21), and pressure data corresponding to the detected press angle is outputted from a angle-pressure converter (corresponding to 7 in FIG. 21). Note that a pressure detection means may be arranged in place of the converter 31.

According to this structure, the resistor 3 is lifted up, and is then pressed against the movable member 31B. Thus, an operation approximate to an operation for swinging a bow downward can be performed. Even when the resistor 3 is pressed at the same force, when the position of the knob 4 is closer to the converter 31, pressure data having a larger value than that obtained when the position of the knob 4 is farther can be obtained. Therefore, a knob operation near the hinge RX corresponds to a bowing operation near the tip end of a bow, and a knob operation near the converter 31 corresponds to a bowing operation at the base side of the bow. Therefore, when the knob 4 is moved from the hinge RX toward the converter 31 and in the opposite direction, down-bow and up-bow strokes in a bowed instrument can be imitated.

Figure 24:
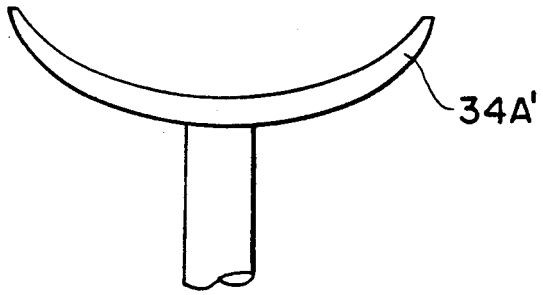
FIG. 24 is a side view showing a modification of the knob.

Note that two end portions along the slide direction of the above-mentioned knob 34A may be curved upward, as designated by 34A' in FIG. 24. With this structure, when a player holds the knob and slides it in the right-and-left direction, his or her hand will not be slipped down from the knob, and an operation can be satisfactorily reflected in a tone.

Figure 25:
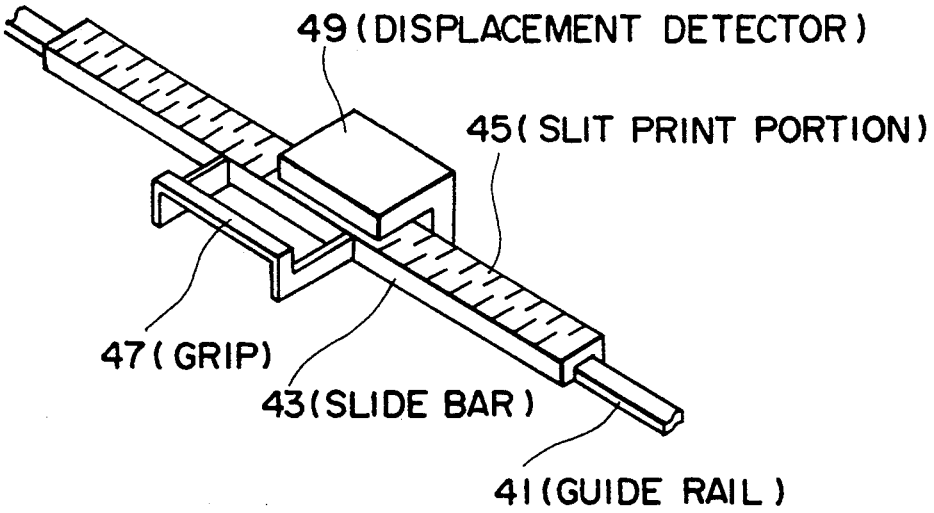
FIGS. 25 and 26 are perspective views showing other performance operation apparatuses.

FIG. 25 shows still another structure of the performance operation apparatus. The apparatus shown in FIG. 25 adopts the principle of a linear encoder. A slide bar 43 is arranged on a guide rail 41 fixed to a support base (not shown) so as to be slidable in the longitudinal direction of the rail. A slit print portion 45 on which two slit patterns having a 90° phase difference are printed is arranged on the upper surface of the slide bar 43, and a grip 47 which is held by a hand during a slide operation is arranged on one side portion of the slide bar 43. A displacement detector 49 for detecting a displacement of the slide bar 43 is fixed to the above-mentioned support base.

The displacement detector 49 has a reader for optically reading the two slit patterns of the slit print portion 45, and performed processing such as direction discrimination, counting, and the like on the basis of the output from the reader, thereby outputting displacement data according to a displacement direction and a displacement amount of the slide bar 43. When the displacement data obtained in this manner is converted into velocity data, as described above with reference to FIG. 3, the tone generator shown in FIG. 5 can be driven in accordance with the velocity data.

In the structure shown in FIG. 25, when a slide operation is performed while holding the grip 47, the grip 47 is moved aside the rail 41. In this case, the grip 47 may be arranged to be moved above or below the rail 41. In the case, the displacement detector 49 reads the slit patterns from a position aside the slide bar 43. Note that pressure sensor may be arranged on or near the rail 41 to detect an operation pressure. In this manner, the tone generator can be driven according to an operation pressure.

Figure 26:
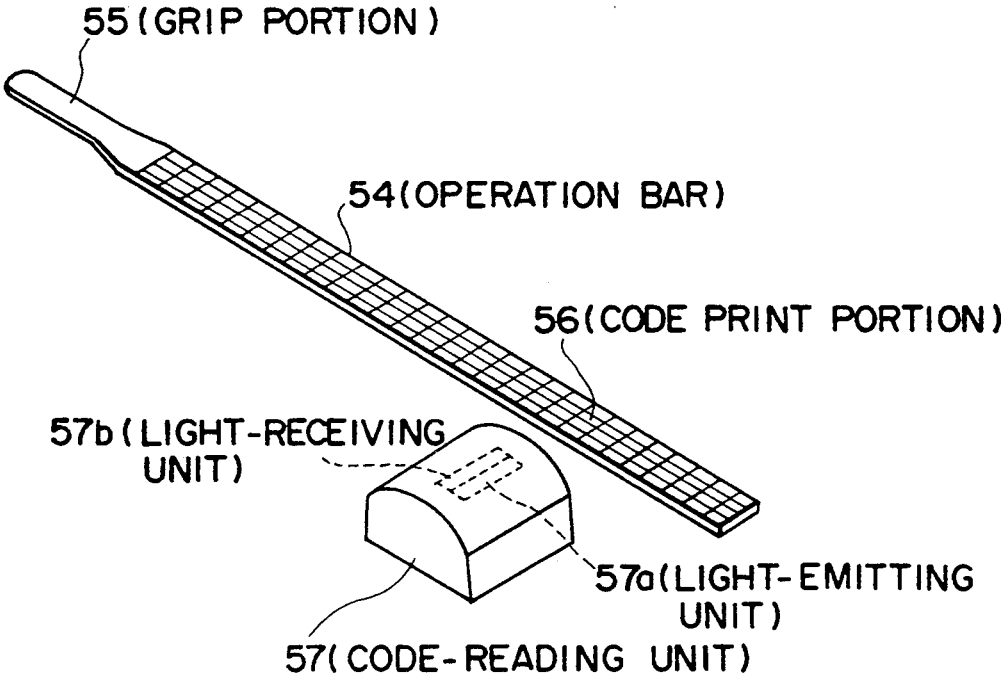

FIG. 26 shows still another structure of the performance operation apparatus. FIG. 26 illustrates a state wherein an operation bar 54 is turned over from a use state. The apparatus shown in FIG. 26 employs the principle of an optical encoder, and comprises the operation bar 54 corresponding to a bow of a bowed instrument, and a code reading unit 57.

A code print portion 56 on which optically readable position codes are printed at predetermined positions along the longitudinal direction is arranged on the lower surface of the operation bar 54. A light-emitting unit 57*a* and a light-receiving unit 57*b* are arranged on the upper surface of the code reading unit 57.

In order to obtain pressure data, a method of arranging a pressure detection unit shown in FIG. 19 on a grip portion 55 of the operation bar 54, a method of arranging a pressure sensor on the upper surface of the code reading unit 57, or the like may be adopted.

When a slide operation is performed so that the lower surface of the operation bar 54 is brought into contact with the upper surface of the unit 57, the code reading unit 57 sequentially reads position codes of the code print portion 56, thus outputting position data.

Position data obtained in this manner can be converted into velocity data, as has been described above with reference to FIG. 2. After displacement data is generated based on position data, the displacement data may be converted into velocity data, as has been described above with reference to FIG. 3. In either case, the tone generator shown in FIG. 5 can be driven in accordance with the obtained velocity data.

In the performance operation apparatus shown in FIG. 26, the operation bar 54 is independent and separate from the code reading unit 57, and its operation direction is not regulated by a groove or a rail, thus obtaining a high degree of freedom in operation. Since the operation bar 54 is light in weight, a quick operation can be performed as compared to an operation of, e.g., the slide resistor. Therefore, a performance operation approximate to a bowing operation of a bowed instrument can be performed.

Note that a member corresponding to the operation bar 54 may be fixed in position, and the code reading unit 57 may be moved along its code print portion. With this structure, position data can also be obtained.

Figure 27:
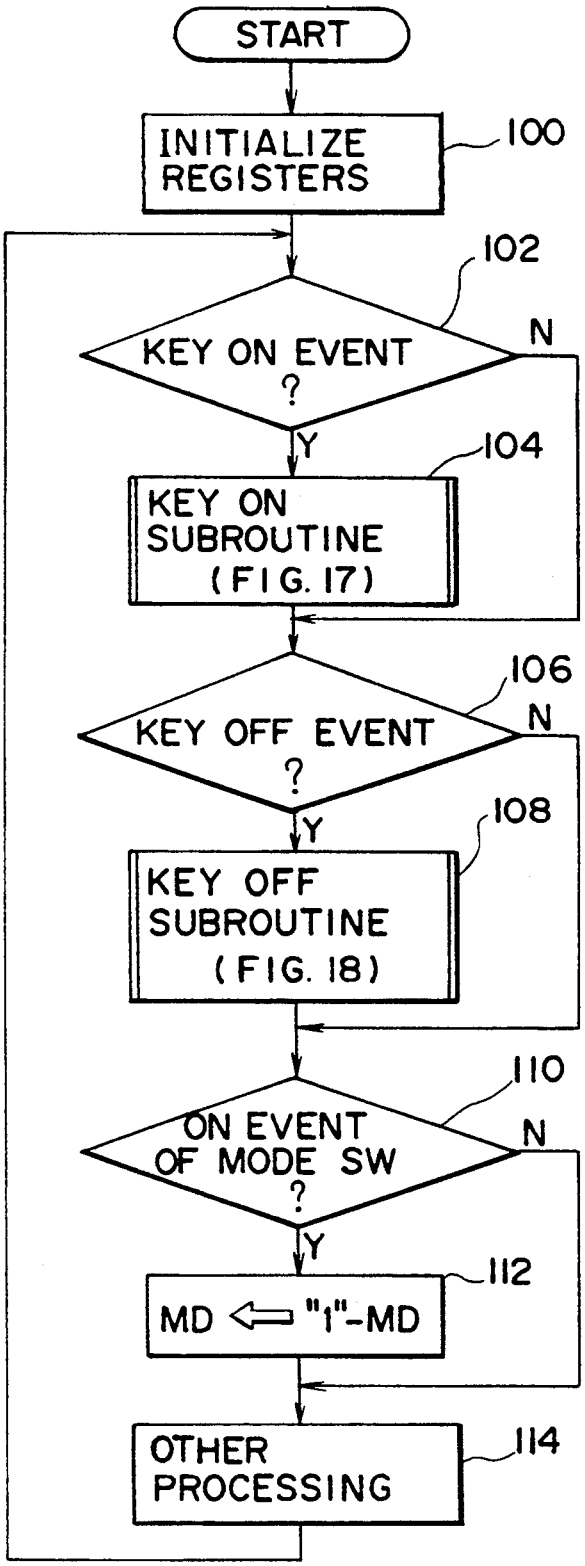
FIG. 27 is a flow chart showing a main routine.

(6) Main Routine (FIG. 27)

FIG. 27 shows a processing flow of the main routine, and this routine is started when, e.g., a power switch is turned on.

In step 100, various registers are initialized. For example, all the registers (1) to (8) are cleared. The flow then advances to step 102.

It is checked in step 102 if a key ON event at the keyboard 36 is detected. If Y (YES) in step 102, a key ON subroutine is executed in step 104, as will be described later with reference to FIG. 28.

In N (NO) in step 102, or if the processing in step 104 is ended, the flow advances to step 106 to check if a key OFF event at the keyboard 36 is detected. If Y in step 106, the flow advances to step 108, and a key OFF subroutine is executed, as will be described later with reference to FIG. 29.

In N in step 106, or if processing in step 108 is ended, the flow advances to step 110 to check if an ON event of the mode switch is detected. If Y in step 110, the flow advances to step 112, and a value obtained by subtracting the content of the register MD from "1" is set in the register MD. More specifically, if the content of the register MD is "0", "1" is set in the register MD; if it is "1", "0" is set in the register MD. As a result, the position and velocity modes can be alternately designated every time the mode switch is turned on.

If N in step 110 or if the processing in step 112 is ended, the flow advances to step 114, and other processing (e.g., tone volume setup processing, and the like) is executed. Thereafter, the flow returns to step 102, and the above-mentioned processing operations are similarly repeated.

Figure 28:
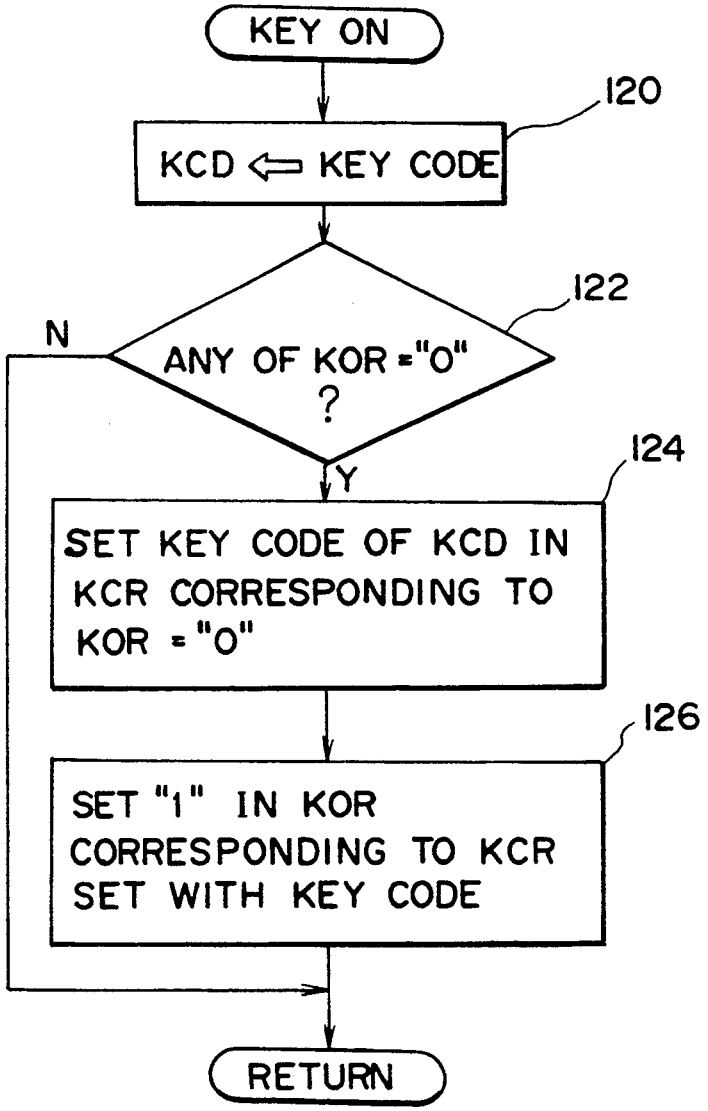
FIGS. 28 and 29 are flow charts respectively showing key ON and key OFF subroutines.

(7) Key ON Subroutine (FIG. 28)

FIG. 28 shows the key ON subroutine. In step 120, a key code associated with the detected key ON event is set in the register KCD. The flow then advances to step 122.

It is checked in step 122 if any one of contents of the registers KOR is "0". If N in step 122, since all the tone generators are in use, the flow returns to the main routine shown in FIG. 27 without executing key code assignment processing.

If Y in step 122, the flow advances to step 124, and the key code stored in the register KCD is set in one of the registers KCR (KCR1 to KCR4 in FIG. 4) corresponding to the register KOR whose content is determined as "0". The flow then advances to step 126.

In step 126, "1" is set in the register KOR corresponding to the register KCR set with the key code. The flow then returns to the main routine shown in FIG. 27.

According to the subroutine shown in FIG. 28, for example, if the register KOR1 is "0", a key code is set in the register KCR1, and "1" is set in the register KOR1, thus allowing musical tone generation of the tone generator TG1.

Figure 29:
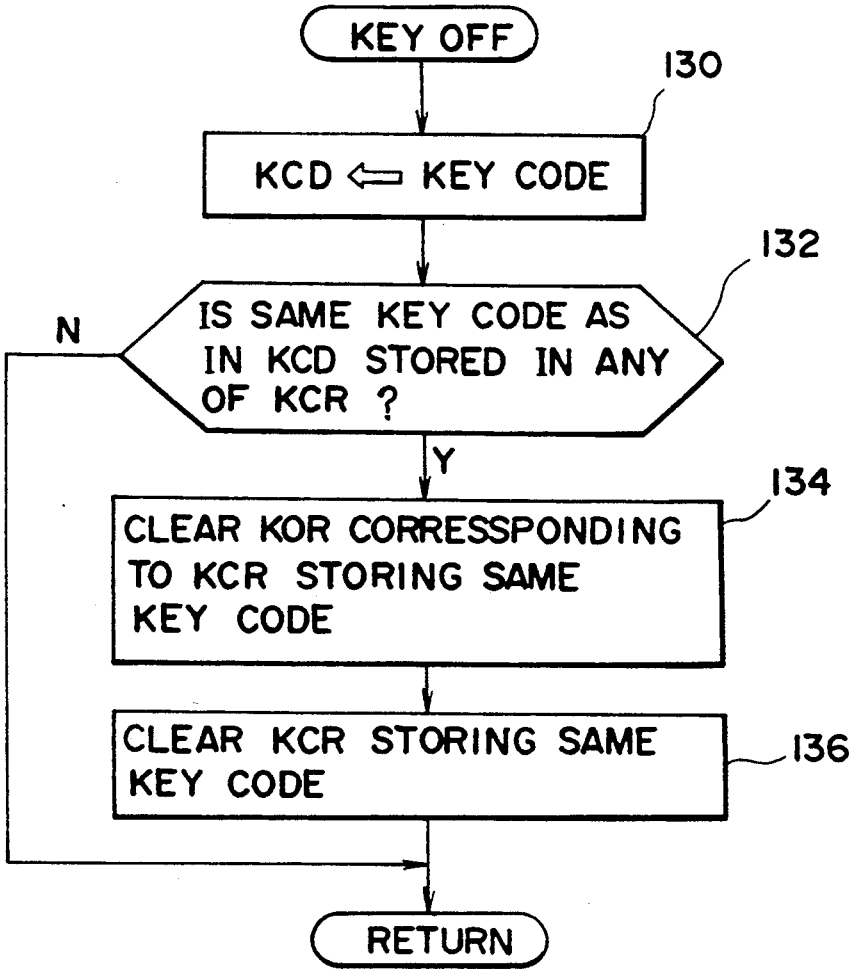

(8) Key OFF Subroutine (FIG. 29)

FIG. 29 shows the key OFF subroutine. In step 130, a key code associated with the detected key OFF event is set in the register KCD. The flow then advances to step 132.

It is checked in step 132 if any one of the registers KCR stores the same key code as that in the register KCD. If N in step 132, since a musical tone corresponding to a key OFF event key is not being generated, and no key OFF processing is necessary, the flow returns to the main routine shown in FIG. 27.

If Y in step 132, the flow advances to step 134, and the register KOR corresponding to the register KCR which stores the same key code is cleared (set to be "0"). In step 136, the register KCR which stores the same key code is cleared, and the flow returns to the main routine shown in FIG. 27.

According to the subroutine shown in FIG. 29, if the register KCR1 stores the same key code as that stored in the register KCD, both the registers KOR1 and KCR1 are cleared. In response to the zero clear operation of the register KCR1, in the tone generator TG1, the delay circuits 60 and 68 shown in FIG. 5 are disabled, and a musical tone in generation begins to be decayed.

Figure 30:
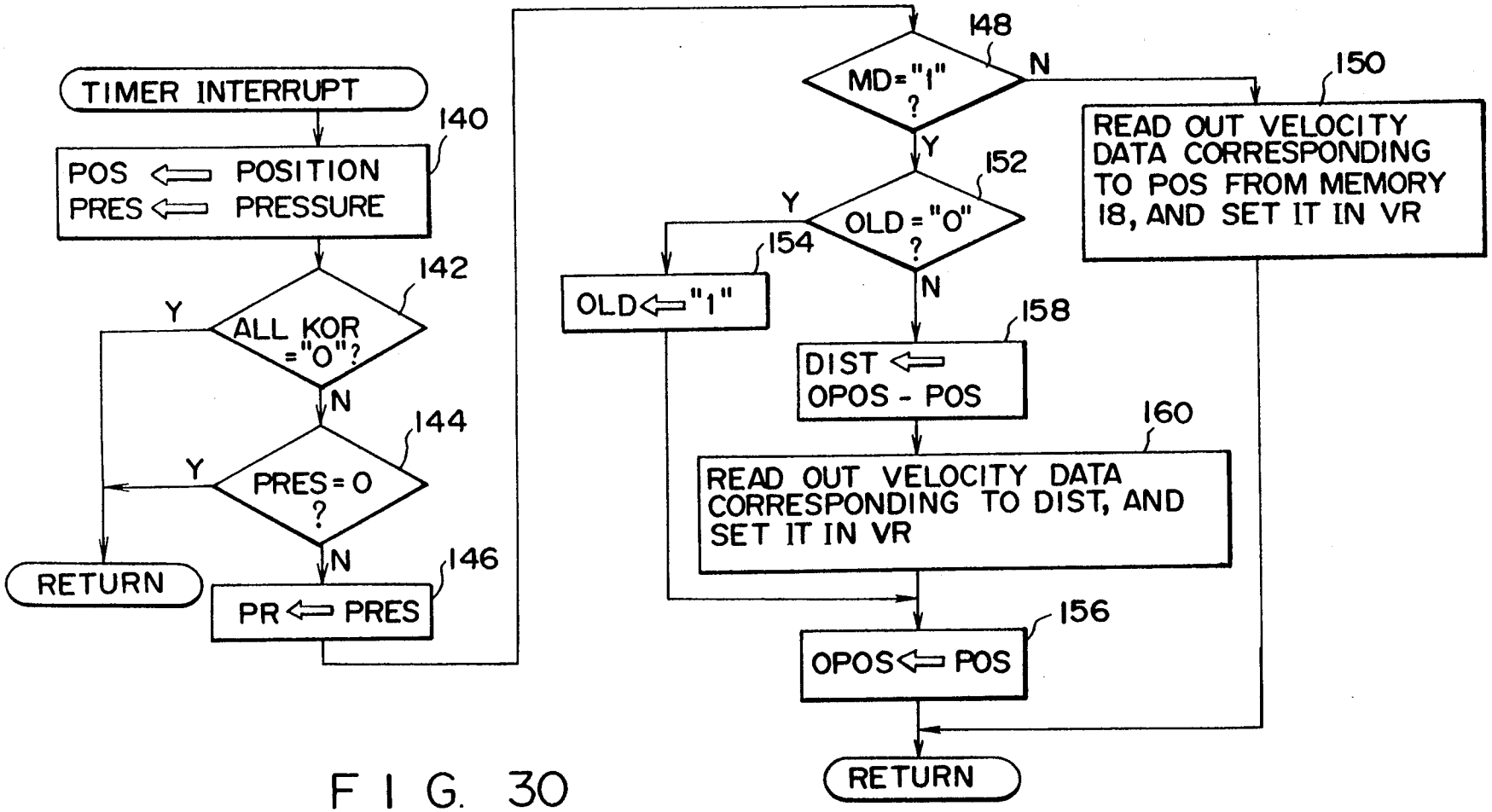
FIG. 30 is a flow chart showing a timer interrupt routine.

(9) Timer Interrupt Routine (FIG. 30)

FIG. 30 shows the timer interrupt routine. This routine is started in response to each clock pulse of the timer clock signal TMC, e.g., at a cycle of 3 ms.

In step 140, position data and pressure data from the detector 22 are respectively set in the registers POS and PRES.

It is checked in step 142 if all the registers KOR are "0". If Y in step 142, since none of the tone generators generate musical tones, and no processing is necessary, the flow returns to the main routine shown in FIG. 27.

If N in step 142, the flow advances to step 144 to check if the content of the register PRES is 0 (if the performance operation apparatus 34 is not operated). If Y in step 144, since processing to be described below is unnecessary, the flow returns to the main routine shown in FIG. 27.

If N in step 144, the flow advances to step 146, and pressure data in the register PRES is set in the register PR (FIG. 4). The flow then advances to step 148.

It is then checked in step 148 if the content of the MD is "1" (velocity mode). If N in step 148, the flow advances to step 150.

If step 150, velocity data corresponding to the value of the register POS is read out from the memory 18, and is set in the register VR (FIG. 4). With the processing in step 150, a velocity can be designated according to a coordinate value (operation position), as shown in FIG. 2. For example, when a position is designated on the right side of $X_m/2$ in the performance operation apparatus 34, a corresponding positive velocity value can be obtained. This corresponds to a bow velocity or input in a pull direction in FIG. 6 or 7. When a position is designated on the left side of $X_m/2$, a corresponding negative velocity value can be obtained. This corresponds to a bow velocity or input in a push direction in FIGS. 6 or 7.

Upon completion of the processing in step 150, the flow returns to the main routine shown in FIG. 27.

If Y in step 148, the flow advances to step 152 to check if the content of the flag OLD is "0" (absence of data in the register OPOS). For example, when step 152 is executed for the first time after the power switch is turned on, Y is determined in step 152, and the flow advances to step 154.

In step 154, "1" is set in the flat OLD. In step 156, the value of the register POS is set in the register OPOS, and the flow then returns to the main routine shown in FIG. 27.

Thereafter, when the control enters the routine shown in FIG. 30 again, N is determined in step 152, and the flow advances to step 158.

In step 158, a difference obtained by subtracting the value of the register POS from the value of the register OPOS is set in the register DIST. The flow advances to step 160.

In step 160, velocity data corresponding to the value of the register DIST is read out from the memory 20, and is set in the register VR (FIG. 4). In step 156, the value of the register POS is set in the register OPOS, and the flow then returns to the main routine shown in Fin. 27.

Figure 3:
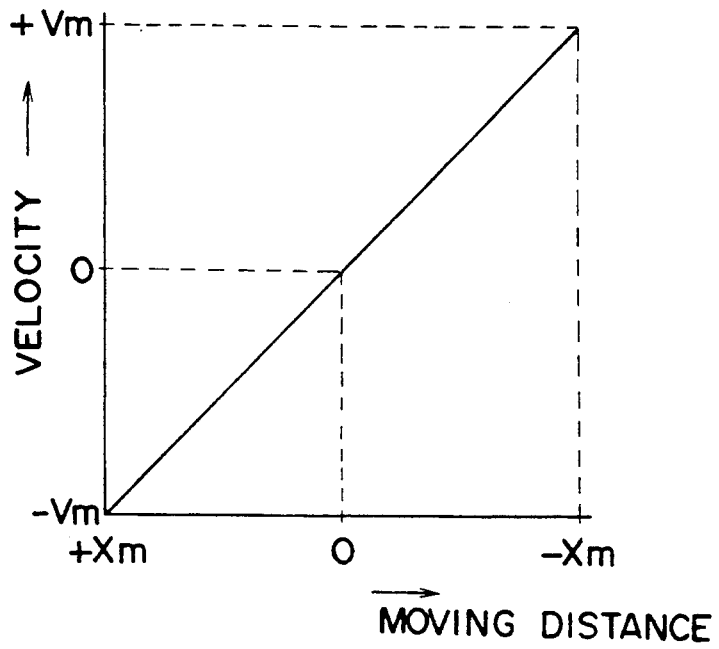

According to the processing operations in steps 152 to 160, a velocity can be designated according to a moving distance per unit time (operation velocity), as shown in FIG. 3. For example, when the knob 34A of the performance operation apparatus 34 is moved to the right, the sign of the difference (OPOS−POS) becomes negative, and a positive velocity value can be obtained in FIG. 3. This corresponds to a bow velocity or input in a pull direction in FIG. 6 or 7. When the knob 34A is moved to the left, the sign of the difference becomes positive, and a negative velocity value can be obtained in FIG. 3. This corresponds to a bow velocity or input in a push direction in FIGS. 6 or 7.

Modification

The present invention is not limited to the above embodiment, and various changes and modifications may be made. For example, the following modifications are available.

(1) The present invention is not limited to a polyphonic electronic musical instrument but may be applied to a monophonic electronic musical instrument.

(2) The performance operation apparatus is not limited to those shown in FIGS. 12 to 26, and various other structures may be adopted. For example, the performance operation apparatus shown in FIG. 12 may adopt a slit pattern read method shown in FIG. 25 or a code read method shown in FIG. 26.

(3) The performance operation apparatus is not limited to one having an operation member such as a knob, but may be one allowing a touch operation.

(4) A musical tone to be controlled is not limited to one which imitates a bowed instrument musical tone, but may be any other sustaining musical tones. For example, the present invention is applicable to musical tones of, e.g., wind instruments. In this case, velocity data can be replaced with a breath pressure, and pressure data can be replaced with a degree of biting an embouchure (or reed), or the like.

Effect of the Invention

As described above, according to the electronic musical instrument of the present invention, rising and falling timings of musical tones can be determined by an operation independently of pitch designation, and various expressions can be added to rising, sustaining, and falling waveforms of musical tones. Therefore, musical tone generation approximate to acoustic instruments such as a bowed instrument, a wind instrument, and the like can be performed.

In addition, according to the musical tone control apparatus of the present invention, musical tones can be controlled over a wide velocity range by a reciprocal operation of a movable operation member, and can also be controlled based on a combination of pressure and velocity data. Therefore, various expressions can be added to sustaining musical tones of, e.g., a bowed instrument.

What is claimed is:

1. An electronic musical instrument for generating musical tones comprising:

(a) operation means which can be slidably operated;

(b) detection means for detecting operation data corresponding to at least one of an operation position and an operation velocity in accordance with an operation of the operation means;

(c) data generation means for generating velocity data on the basis of the operation data outputted from the detection means; and (d) musical tone generation means for generating a musical tone signal having musical tone characteristics according to the velocity data outputted from the data generation means, under a condition that said operation means is in operation, said musical tone generation means comprising:

(e) nonlinear circuit means for receiving said velocity data and for generating a signal having a nonlinear characteristic; and (f) a closed loop for circulating the signal outputted from said nonlinear circuit means, said closed loop comprising delay means for delaying the signal, and a circulating path for circulating the signal, wherein the total delay time in the closed loop determines the pitch of said musical tone.

2. An instrument according to claim 1, further comprising pitch designation means for designating tone pitch, and wherein said musical tone generation means generates a musical tone of a pitch designated by said pitch designation means.

3. An instrument according to claim 1, wherein said data generation means generates said velocity data corresponding to said operation position.

4. An instrument according to claim 2, wherein said data generation means generates said velocity data corresponding to said operation position.

5. An instrument according to claim 1, wherein said data generation means generates said velocity data corresponding to said operation velocity.

6. An instrument according to claim 2, wherein said data generation means generates said velocity data corresponding to said operation velocity.

7. An electronic musical instrument for generating musical tones comprising:

(a) operation means which can be slidably operated;

(b) detection means for detecting operation data corresponding to an operation position and an operation velocity of said operation means in accordance with an operation of the operation means;

(c) data generation means for generating velocity data on the basis of the operation data outputted from the detection means, said data generation means having mode selecting means for selecting one of first and second modes and, generating velocity data corresponding to the operation position when the first mode is selected and generating velocity data corresponding to an operation velocity of said operation means when the second mode is selected; and (d) musical tone generation means for generating a musical tone signal having musical tone characteristics according to the velocity data outputted from the data generation means, under a condition that said operation means is in operation, said musical tone generation means comprising:

(e) nonlinear circuit means for receiving said velocity data and for generating a signal having a nonlinear characteristic; and (f) a closed loop for circulating the signal outputted from said nonlinear circuit means, comprising:

delay means for delaying the signal; and a circulating path for circulating the signal; wherein the total delay time in the closed loop determines the pitch of said musical tone.

8. An instrument according to claim 7, further comprising pitch designation means for designating tone pitch, and wherein said musical tone generation means generates a musical tone of a pitch designated by said pitch designation means.

9. An instrument according to any one of claims 1–6, wherein said detection means detects pressure data corresponding to an operation pressure in accordance with an operation of said operation means, and the musical tone characteristics of said musical tone generation means is controlled in accordance with the pressure data outputted from said detection means.

10. An instrument according to claim 7, wherein said detection means detects pressure data corresponding to an operation pressure in accordance with an operation of said operation means, and the musical tone characteristics of said musical tone generation means is controlled in accordance with the pressure data outputted from said detection means.

11. An instrument according to claim 8, wherein said detection means detects pressure data corresponding to an operation pressure in accordance with an operation of said operation means, and the musical tone characteristics of said musical tone generation means is controlled in accordance with the pressure data outputted from said detection means.

12. An electronic musical instrument comprising:

(a) an operation member which can be movably operated;

(b) detection means for detecting operation data according to at least one of an operation position and displacement amount of the operation member along its moving direction;

(c) conversion means for converting the operation data outputted from the detection means into velocity data;

(d) control means for controlling musical tone characteristics on the basis of the velocity data outputted from the conversion means;

(e) a nonlinear circuit for generating a signal having a nonlinear characteristic; and (f) a closed loop for circulating the signal outputted from said nonlinear circuit, comprising:

delay means for delaying the signal; and a circulating path for circulating the signal; wherein the total delay time in the closed loop determines the pitch of said musical tone, said nonlinear circuit and delay mean constituting a musical tone generation means.

13. An instrument according to claim 12, further comprising pressure detection means for detecting pressure data according to an operation pressure of said operation member, and said control means controls the musical tone characteristics on the basis of velocity data outputted from said conversion means and pressure data outputted from said pressure detection means.

14. An instrument according to claim 12, further comprising a pressure detection unit arranged on a portion of said operation member and pressure detection means for detecting pressure data according to an operation pressure at the pressure operation unit, and wherein said control means controls the musical tone characteristics on the basis of the velocity data outputted from the conversion means and the pressure data outputted from the pressure detection means.

15. An instrument according to claim 12, further comprising pressure designation means for generating pressure data according to a movement in a direction different from a longitudinal direction of said operation member and a moving direction of said operation member, and wherein said control means controls the musical tone characteristics on the basis of the velocity data outputted from said conversion means and the pressure data outputted from said pressure designation means.

* * * * *